US008262027B2

(12) United States Patent
Hartasanchez Castillo

(10) Patent No.: US 8,262,027 B2
(45) Date of Patent: Sep. 11, 2012

(54) AUTOMATIC FOLDING STRUCTURE FOR KITES

(75) Inventor: Roberto Hartasanchez Castillo, Gijón (ES)

(73) Assignee: EOLO-Sport Industrias, S.A., Gijon, Asturias (ES)

( * ) Notice: Subject to any disclaimer, the term of this patent is extended or adjusted under 35 U.S.C. 154(b) by 147 days.

(21) Appl. No.: 12/777,954

(22) Filed: May 11, 2010

(65) Prior Publication Data

US 2010/0320328 A1 Dec. 23, 2010

(30) Foreign Application Priority Data

Jun. 23, 2009 (ES) ..... 200901028

(51) Int. Cl.
*A63H 27/04* (2006.01)

(52) U.S. Cl. ..... 244/153 R; 244/155 A

(58) Field of Classification Search ..... 244/154 R, 244/154, 155 A, 155 R, 153 A; D21/445, D21/446
See application file for complete search history.

(56) References Cited

U.S. PATENT DOCUMENTS

| | | | | | |
|---|---|---|---|---|---|
| 671,865 | A * | 4/1901 | Mowrer et al. | ..... | 244/153 R |
| 1,690,362 | A * | 11/1928 | De Witt | ..... | 244/153 R |
| 1,868,525 | A * | 7/1932 | De Mott | ..... | 244/153 R |
| 3,193,224 | A * | 7/1965 | Williamson | ..... | 244/153 R |
| 3,749,338 | A * | 7/1973 | Kinsey | ..... | 244/153 R |
| 4,150,804 | A * | 4/1979 | Jackson | ..... | 244/153 R |
| 4,958,787 | A * | 9/1990 | Sterling | ..... | 244/153 R |
| 5,000,403 | A * | 3/1991 | D'Alto | ..... | 244/155 A |
| 5,833,174 | A * | 11/1998 | Knight et al. | ..... | 244/155 A |
| 6,604,713 | B1 * | 8/2003 | Holmes | ..... | 244/153 R |
| 2004/0007646 | A1 * | 1/2004 | Chang | ..... | 244/153 R |

* cited by examiner

*Primary Examiner* — Benjamin P Lee
(74) *Attorney, Agent, or Firm* — Merchant & Gould P.C.

(57) ABSTRACT

Folding structure for kites, applicable in kites equipped with an internal structure based on rods assembled within the interior of a specific external part of the kite's fabric (1). It allows the kite to be folded and unfolded. It is characterized by the fact that the internal structure is complemented by a central longitudinal rod (2) running through the entire kite. The rod (2) supports various tensing trusses (3) with folding arms (4), which are movable in both directions and associated to a further range of rods (5), and which constitutes the folding structure of the kite.

6 Claims, 4 Drawing Sheets

AUTOMATIC FOLDING STRUCTURE FOR KITES

This application claims benefit of Serial No. 200901028, filed 23 Jun. 2009 in Spain and which applications are incorporated herein by reference. To the extent appropriate, a claim of priority is made to the above disclosed application.

OBJECT OF THE INVENTION

The invention refers to a folding structure for kites, based on the installation of a central, longitudinal rod running along the length of the kite and upon which a series of tensing trusses or sliding connectors are mounted. The trusses support rods employed for tensing and pulling the kite's internal section and form arches when assembled or unfolded. The object of the invention is to ensure the total versatility of the folding structure in order to construct different types of kite designs, in such a manner that the structure is assembled automatically by pulling on one of its extremes. When the other extreme is pulled, the structure folds automatically.

BACKGROUND OF THE INVENTION

As is known, kite design does not only cover flat kites, as kites are designed with different forms and geometries in representation of animals, aeroplanes, etc. Kites are assembled manually by placing, one by one, all the internal rods which make up the kite's structure. In many cases, this process can be confusing and the rods may be installed incorrectly, making the correct assembly of the kite in question impossible and requiring the removal of the rods and their correct reinstallation.

On the other hand, kites are always accompanied by lengthy installation manuals that the user is sometimes unable to understand, which means more problems and inconvenience. That is to say, the assembly and dismantling of a kite involves long periods of time and effort on behalf of the user, which complicates their subsequent use.

DESCRIPTION OF THE INVENTION

The folding structure for kites recommended here, and which has been designed to resolve the above-mentioned problems, is based on the idea that the different parts of the kite, and specifically the external part or fabric, may be quickly and easily folded and unfolded. More specifically, the internal structure of the kite, which logically constitutes the support for the external part of the fabric, is characterized by the incorporation of a central, longitudinal rod which runs throughout the fabric that constitutes the outer part. The rod, in turn, supports an indeterminate number of tensing trusses, which in turn support a multitude of arms to which a similar number of rods are attached. These rods are employed to tense the external part or fabric of the kite to which they are permanently attached. The rods, thus, do not leave their correct position when the kite is folded. The tensing trusses are simultaneously connected to a rope or string that also runs along the kite and the ends of which extend along the external part or fabric, terminating in rings which are manipulated manually. The above-mentioned tensing trusses are freely-mounted and, thus, can be moved in either direction along the longitudinal rod. These tensing rods move simultaneously in the same direction, in accordance with the force applied to either one of the extremes of the above-mentioned string. The pulling of either end of the string enables the kite to be assembled or dismantled, or folded or unfolded, and prepared either for its use or for its storage in a bag or box. When folded, all the tensing trusses remain aligned on one side of the kite, with the connected rods remaining folded and free of tension with respect to the fabric that forms the outer part of the kite. If, in this situation, the ring attached to the string that connects the tensing trusses is pulled from the side towards which the tensing rods are pointed, these rods will move through the longitudinal rod and gradually open up and tense the fabric as they turn over the structural arms, in such a manner that, at a specific point, all the rods are subject to a positive and permanent tension, forming a dome with the rods to hold the outer fabric fully stretched and ready to fly. Similarly, by pulling on the string's other ring, the structure, at a specific point, will lose the positive tension to which it is subject and the trusses will move along the longitudinal rod until they are fully folded, thus reducing their form and allowing the subsequent introduction of the kite into a bag for storage. Obviously, the number of tensing trusses may vary, as well as the number of arms supporting the trusses, in accordance with the size, shape and morphological features of the kite in question.

DESCRIPTION OF THE DRAWINGS

To complement the following description and in order to facilitate a greater understanding of the invention's features, in accordance with a practical example of the same, a set of indicative drawings has been attached as an integral part of the description, representing the following.

PREFERRED IMPLEMENTATION OF THE INVENTION

Figure 1:
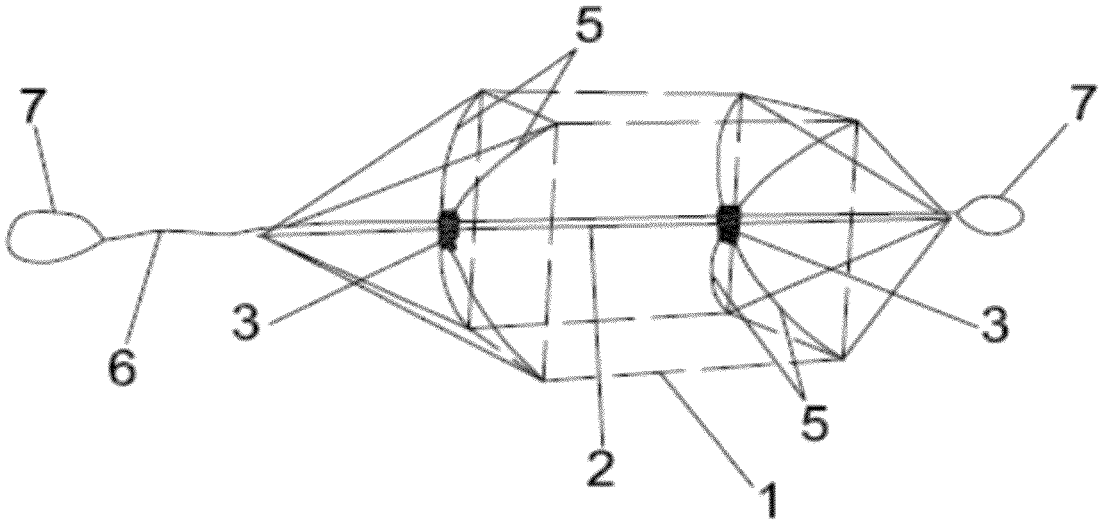
FIG. 1.—Shows a schematic representation of a basic example of kite with an assembled folding structure, i.e., in its unfolded state.
Figure 2:
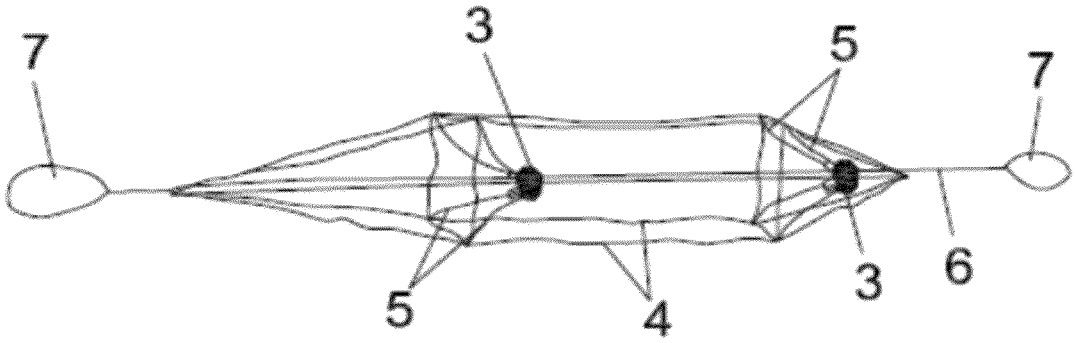
FIG. 2.—Shows the same kite represented in the previous figure in a semi-folded position.
Figure 3:
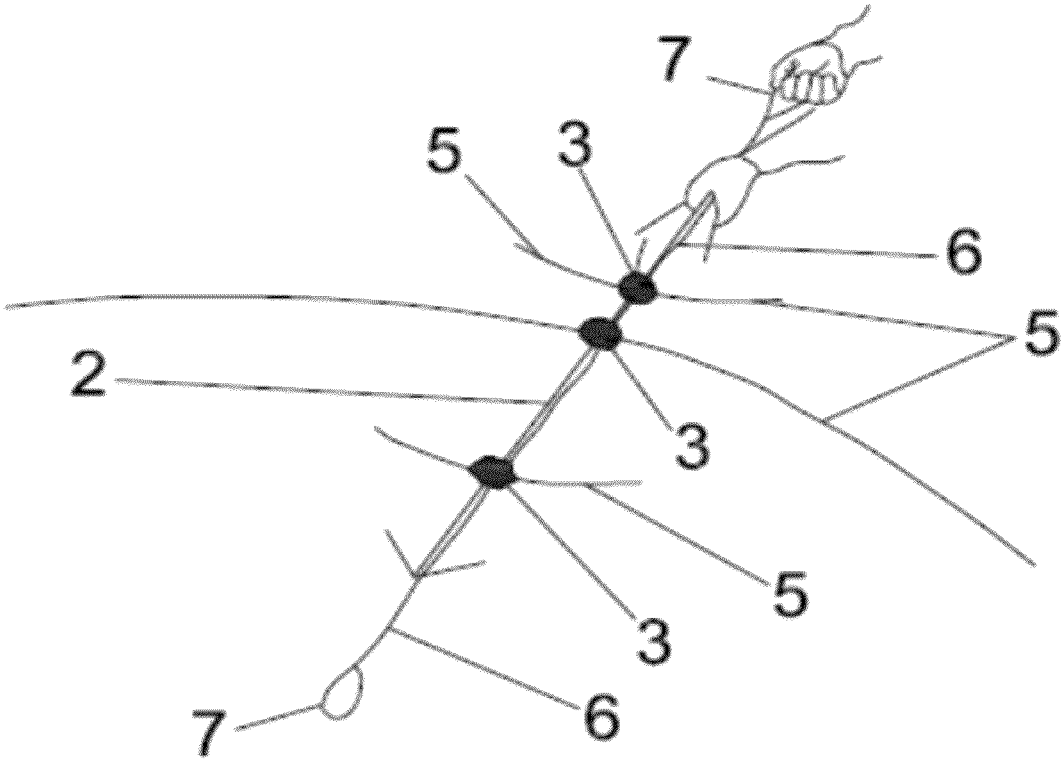
FIG. 3.—Shows a partial representation of the internal folding structure in its unfolded state.
Figure 4:
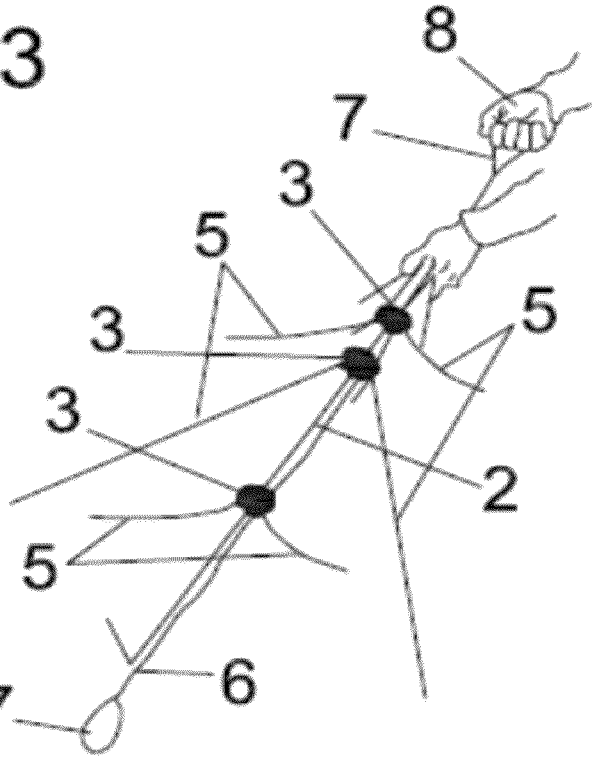
FIG. 4.—Shows the same representation as the previous figure, now in a semi-folded state.
Figure 5:
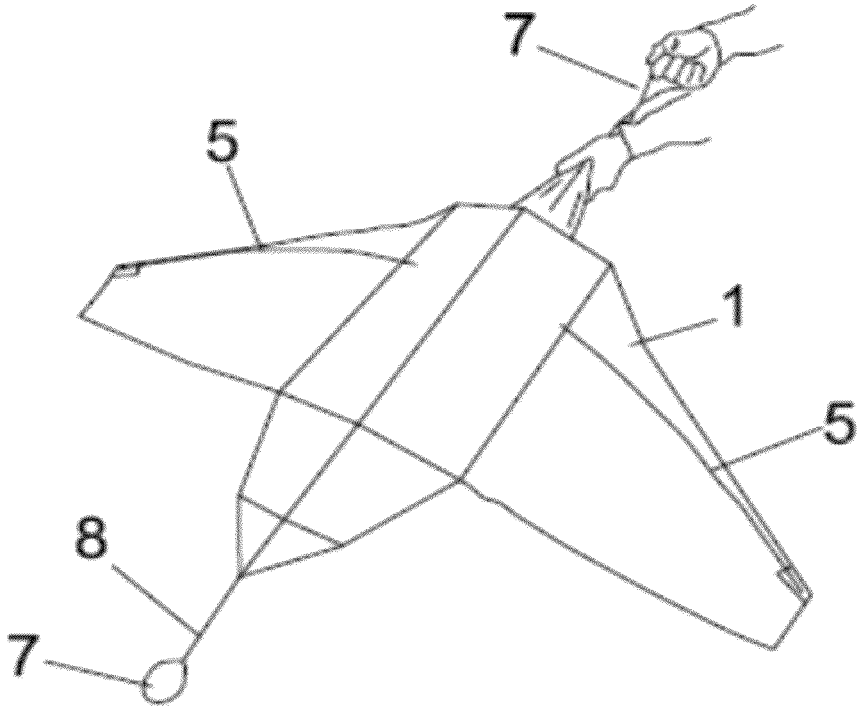
FIG. 5.—Shows the kite fitted with the invention with its exterior fabric unfolded.
Figure 6:
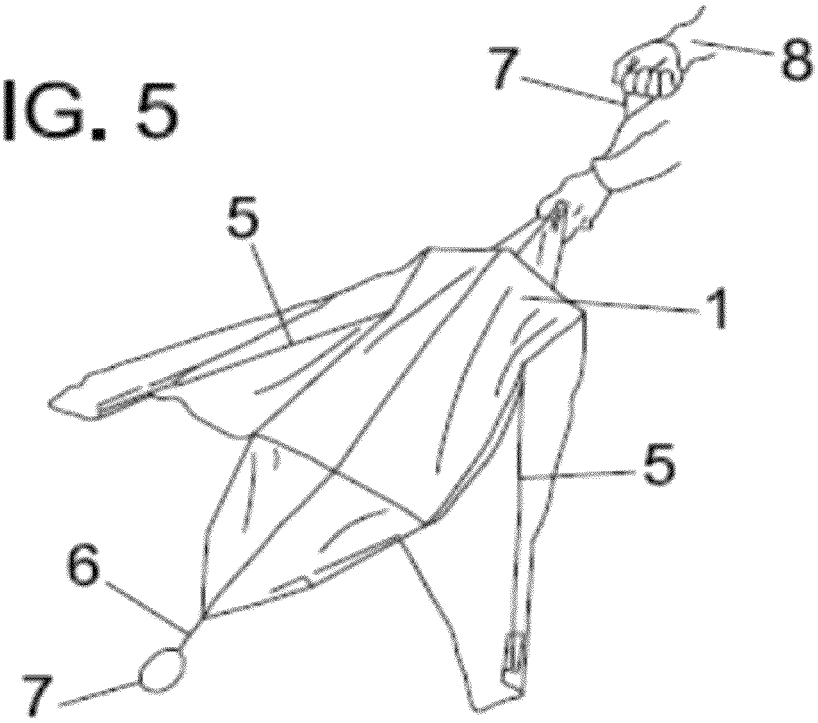
FIG. 6.—Shows a similar view to that shown in the previous figure with the outer fabric semi-unfolded.
Figure 7:
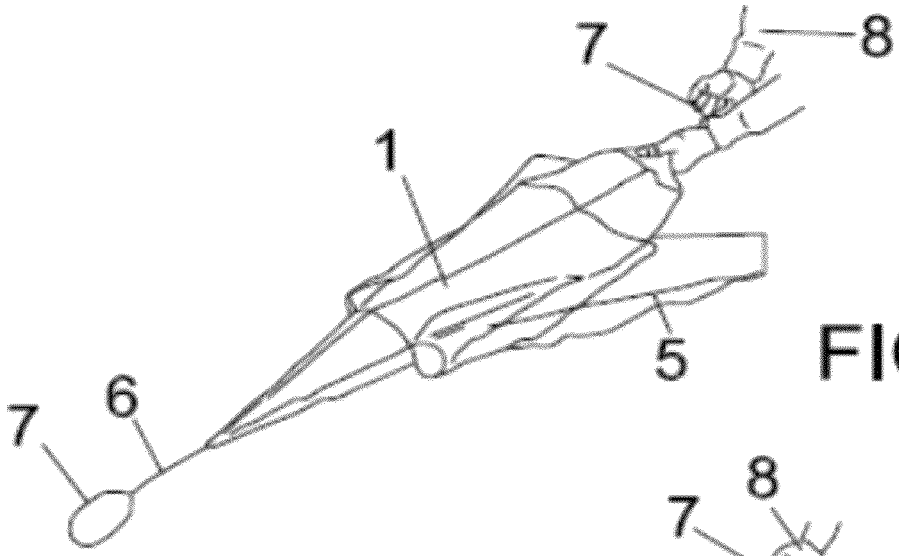
FIG. 7.—Shows a representation of the kite in the folded position as one of the extremes of the string is pulled to commence the unfolding action.
Figure 8:
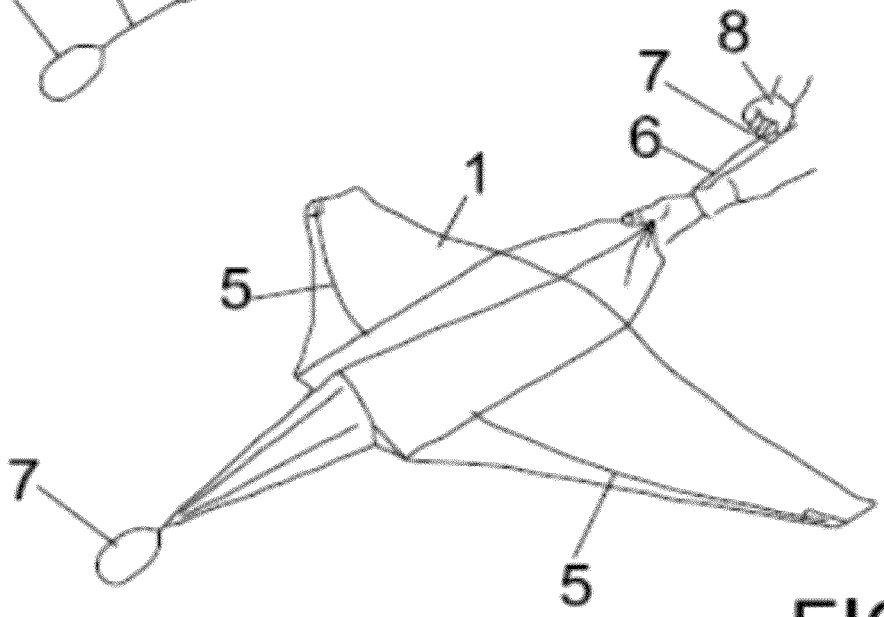
FIG. 8.—Shows the same kite as represented in the previous figure in the unfolded position.
Figure 9:
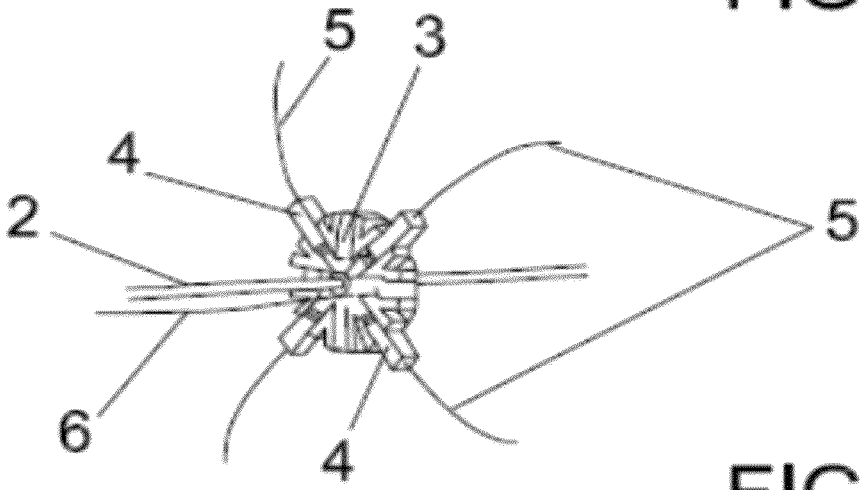
FIG. 9.—Shows, finally, a perspective view of one of the tensing trusses, with its corresponding associated arms and rods.

As can be seen in figures above, the kite which is the subject of the invention includes, as is conventional, an internal structure that determines the folding and unfolding of the kite, and an outer fabric part (1) which serves as accommodation for mentioned internal structure. The internal structure is composed of a centrally-located longitudinal rod (2) running from one extreme of the structure to the other. The structure's centrally-located longitudinal rod (2) supports a number of tensing trusses (3) upon which a variable number of arms (4) are mounted. These arms may adopt both folded and unfolded positions. The arms (4), in turn, support a further set of rods (5), as shown in FIG. 9, forming the internal structure of the kite. The tensing trusses (3), with corresponding arms and rods (5), are mounted on the longitudinal rod (2), along which they may move in both directions in order that the rods (5), as a result of movement in either direction of tensing trusses (3), may tense the outer part or fabric (1), or fold the same. The kite includes an axial, longitudinal string (6), which also runs through the interior and protrudes at the extremes. Rings (7) used for pulling the string are attached to each extreme of the same. The tensing trusses (3) are attached to this string (6). When pulled in one direction or the other through one of the rings (7), the string (6) draws the mentioned tensing trusses (3) with it along the length of the longitudinal rod (2), enabling the folding or the unfolding of the internal structure and the kite in question. As shown in FIG. 2, the kite appears in a semi-dismantled, that is to say semi-folded, state. In this position, the tensing trusses (3) and their corresponding arms (4) have been simultaneously displaced as a resulting of the pulling of one of the rings (7), with the rods (5) having lost the positive tension that maintained the external part (4) in its unfolded or assembled state. FIG. 3 shows the kite's internal folding structure in its assembled position, while FIG. 4 shows the mentioned internal structure in a semi-folded position following the pulling of the ring (7) by hand (8), as can be seen in the FIG. 4. However, FIG. 5 shows the kite with its the external part or fabric (1) in its unfolded state. In FIG. 6, we can see this external part or fabric (1) in its semi-unfolded position, following the pulling of the ring (7) by hand (8), which is also shown in FIG. 6. FIG. 7 shows the kite in its folded stated, achieved by pulling the ring (7) in which there is no string (6) by hand (8) outside the kite, with the aim of commencing the unfolding operation. FIG. 8 shows the fully-unfolded kite, achieved by pulling on the ring (7) by hand (8), located on the opposite side of the ring in question (7) where it corresponds with the extreme of the kite's external part or fabric, thus impeding further pulling on the above-mentioned ring (7). Finally, FIG. 9 shows one of the tensing trusses with its corresponding arms (4), upon which the corresponding rods (5) are assembled, in the unfolded position. The rods are maintained by the positive tension that they generate between themselves. Upon pulling on the string (6), which leads to the corresponding movement of the tensing trusses (3) along the longitudinal rod (2), the rods (5) lose their positive tension and, therefore, the arms (4) turn until the structure, and the kite, is fully folded.

The invention claimed is:

1. A folding structure for a kite comprising an internal structure based on rods assembled within an interior of an external part of the kite's fabric;

the internal structure comprising:

a central longitudinal rod running through the kite;

a plurality of tensioning trusses with folding arms, the tensioning trusses being slidably movable in either direction along the longitudinal rod;

a plurality of tensioning rods mounted to the tensioning trusses, and which comprise the folding structure of the kite;

a string running the entire length of the kite and connected to the tensioning trusses;

a manual pull ring fitted to each extreme of the string;

wherein pulling the string in a first direction subjects, the tensioning rods to a positive tension and the fabric of the kite is automatically unfolded; and wherein pulling the string in a second opposite direction releases the positive tension and the kite folds automatically.

2. A folding structure for a kite according to claim 1, wherein the string pulls the trusses in the first direction to subject the tensioning rods to positive tension and the string pulls the trusses in the second direction to release the positive tension.

3. A folding structure for a kite according to claim 1, wherein the tensioning rods engage the fabric to provide positive tension.

4. A folding structure for a kite according to claim 3, wherein the tensioning rods arch under the positive tension from engaging the fabric.

5. A folding structure for a kite according to claim 1, wherein the tensioning rods extend radially from the tensioning trusses.

6. A folding structure for a kite according to claim 1, wherein the folding structure comprises at least three tensioning trusses.

* * * * *